US005503298A

United States Patent [19]

Herman et al.

[11] Patent Number: 5,503,298

[45] Date of Patent: Apr. 2, 1996

[54] BAGEL DISPENSER

[76] Inventors: Richard J. Herman, P.O. Box 1700, Hendersonville, N.C. 28739; Robert L. Jones, P.O. Box 728, Saluda, N.C. 28773

[21] Appl. No.: 342,762

[22] Filed: Nov. 21, 1994

[51] Int. Cl.[6] ..... B65H 1/06

[52] U.S. Cl. ..... 221/53; 221/250; 221/268; 221/270; 221/276

[58] Field of Search ..... 221/268, 270, 221/271, 276, 247, 250, 53, 312 R, 280

[56] References Cited

U.S. PATENT DOCUMENTS

| | | | |
|---|---|---|---|
| 1,198,042 | 9/1916 | Madden | 221/271 |
| 1,465,902 | 8/1923 | Gould | 221/271 |
| 2,202,578 | 5/1940 | Friemering | 221/268 X |
| 2,211,349 | 8/1940 | Nye | 221/250 X |
| 2,819,819 | 1/1958 | Warren | 221/250 X |
| 3,133,671 | 5/1964 | Christine et al. | 221/271 |
| 3,162,322 | 12/1964 | Gilbertson | 221/135 |
| 5,219,092 | 6/1993 | Morand | 221/53 |
| 5,323,920 | 6/1994 | Harris et al. | 221/197 |

FOREIGN PATENT DOCUMENTS

| | | | |
|---|---|---|---|
| 59522 | 6/1913 | Austria | 221/250 X |
| 2124360 | 11/1972 | Germany | 221/197 X |
| 3290792 | 12/1991 | Japan | 221/268 X |
| 64353 | 1/1913 | Sweden | 221/268 X |

*Primary Examiner*—William E. Terrell
*Assistant Examiner*—Dean A. Reichard
*Attorney, Agent, or Firm*—Joseph T. Guy, Jr.

[57] ABSTRACT

An apparatus for dispensing a bagel is provided which is aesthetically pleasing, sanitary and requires a minimal amount of area. Specifically described is a dispenser comprising: a base comprising a front, a top, a right side and a left side and a pair of matching parallel slots along each right side and left side; a pusher assembly on top of the base comprising; a contact face; an inclined plate; a pair of support members attached to the inclined plate and extending downward wherein each support member further comprises a hole aligned with one slot; a rod, and associated handle, protruding through the front of the base; a connector attached to the rod comprising; a pair of fingers wherein each finger extends through one of the matching parallel slots of the base and into the hole of the support member; a storage column comprising; a front exit slot; a rear entrance slot.

18 Claims, 4 Drawing Sheets

BAGEL DISPENSER

BACKGROUND OF THE INVENTION

This invention is generally related to a dispenser. More specifically this invention is related to an apparatus which dispenses bagels, or other items, without allowing the operator to contact the undispensed item.

Bagels, and similar food products, are typically dispensed in one of several ways. They may be pre-packaged into lots of say 6 or 12. This requires a person, or machine, to pack and seal the individual bags. The additional work, or equipment, increases the cost of the goods sold. Also the number of items in a bag, or the mixture of items, will not be suitable to every shopper.

Alternatively, the goods are distributed by an assistant who takes the custom order and then attends to filling of the order. This requires a person to be available at all times which again increases the cost of the goods sold.

It is most preferable to allow the shopper to choose the items themselves and to package the items without the assistance of store personnel. This is typically accomplished by the use of covered bins which are equipped with a scoop, tongs, or the like, to grasp the items and insert them into a bag. Most shoppers find this acceptable yet several problems exist.

Self-serve bins are miss-used by the shoppers and quite frequently the shopper may use their hand to retrieve the items. The risk of passing germs onto the other items in the bin is always present. This is a particular problem with children. Also the bin covers are frequently left open thereby allowing insects to enter the bin. It is not uncommon for the bins to become unsightly and the purchase of the goods becomes unappealing. Circumventing these problems by providing an attendant again increases the cost of the goods sold. There has been a long felt need for a dispenser which can dispense one bagel, or other item, at a time and which eliminates the problems associated with shoppers coming into contact with the items. Protection against insects, and the like, from entering the container is also highly desirable.

Automatic dispensers of many types are available yet none are suitable for the dispensing of dry goods such as bagels. Several properties are specific to bagels which make known dispensers unsuitable. Firstly, bagels are fairly soft and therefore a mechanism must be developed which will distribute them without undo force and which will not cause breaking or crumbling. Secondly, a bagel is typically covered with poppy seeds, or the like, and is susceptible to form crumbs regardless of the handling mechanism. A dispenser is preferred which will be self purging of crumbs and which does not have places for crumbs to accumulate. Thirdly, bagels are rarely uniform in size or thickness which increases the problems associated with designing a dispenser which is equally effective for a wide variety of sizes and shapes. A dispenser should be compact and capable of being bunched together since the space available is limited in most stores. Additionally, a dispenser must be aesthetically pleasing and must be of such a design that the goods are easily seen and are made to look appealing.

A dispenser has been described by Gould, U.S. Pat. No. 1,465,902 for distribution of cigarette packs and the like. The dispenser of Gould illustrates the deficiencies of most presently available dispensers relative to their use with items such as bagels. The mechanism which pushes the pack out of the dispenser uses a trigger mechanism wherein the handle is pulled back to actuate a plunger. As the plunger is withdrawn out of the storage bin a pack of cigarettes falls into the space vacated by the plunger. After the plunger reaches a certain point the trigger mechanism allows the plunger to push against the pack thereby ejecting it out of the front slot. A cigarette pack is of uniform size and shape and the manner in which a stack of packs will fall is predictable. Furthermore, a trigger mechanism is not a concern since a cigarette pack is relatively rigid and less susceptible to damage than bagels. A trigger mechanism, as employed by Gould, would likely damage bagels, or similar items. Also the plunger mechanism can not be guaranteed to expel only one item since the thickness may be different with each sample.

SUMMARY OF THE INVENTION

It is an object of the present invention to provide an improved dispenser.

It is another object of the present invention to provide a dispenser which is suitable for distribution of bagels, and the like.

It is another object of the present invention to provide a dispenser which does not harm the item being dispensed.

It is yet another object of the present invention to provide a dispenser which is capable of being grouped together in a limited amount of space without loss of aesthetic appeal.

The inventive dispenser is eminently suitable for dispensing items with the particular advantages:

a) the items are easily visualized prior to dispensing;

b) the items which are not dispensed do not come into contact with the person activating the dispenser;

c) crumbs, and the like, are purged during the dispensing action;

d) the items in the cue are slightly lifted which decreases the force required to dispense the item thereby minimizing damage.

These and other advantages will be apparent from the description wherein provided is a dispenser suitable for dispensing bagels comprising: a base comprising a front and rear; a storage column attached to said base for stacking a multiplicity of bagels in a single column wherein said storage column comprises a front side and a rear side; an exit slot in said front side of said storage column; a push assembly slidably mounted on said base wherein said push assembly comprises; a contact face; an inclined plate attached to the upper extent of said contact face; a moveable handle connected to said push assembly; wherein movement of said handle causes said push assembly to move along said base such that said contact face of said push assembly pushes a bagel into said exit slot of said front side of said storage column.

Another embodiment of the present invention is provided in a dispenser for an item comprising; a base comprising a top and a bottom; a pusher assembly slidably attached to said top of said base wherein said pusher assembly comprises a contact face comprising an upper extent and a lower extent; and an inclined plate attached to said upper extent of said contact face; a storage column on top of said base wherein said storage column comprises a rear entrance slot and a front exit slot; a movable handle attached to said pusher assembly such that movement of said handle slides said pusher assembly into said rear entrance slot of said storage column causing said contact face to slide said item into said front exit slot of said storage column.

Yet another embodiment of the present invention is provided in a dispenser comprising: a base comprising a front, a top, a right side and a left side and a pair of matching parallel slots along each of said right side and said left side; a pusher assembly on top of said base comprising; a contact face; an inclined plate; a pair of support members attached to said inclined plate and extending downward wherein each said support member further comprises a hole aligned with one said slot; a rod, and associated handle, protruding through said front of said base; a connector attached to said rod comprising; a pair of fingers wherein each said finger extends through one of said matching parallel slots of said base and into said hole of said support member; a storage column comprising; a front exit slot; a rear entrance slot.

DETAILED DESCRIPTION OF THE INVENTION

Throughout the following description similar elements are numbered accordingly.

Figure 1:
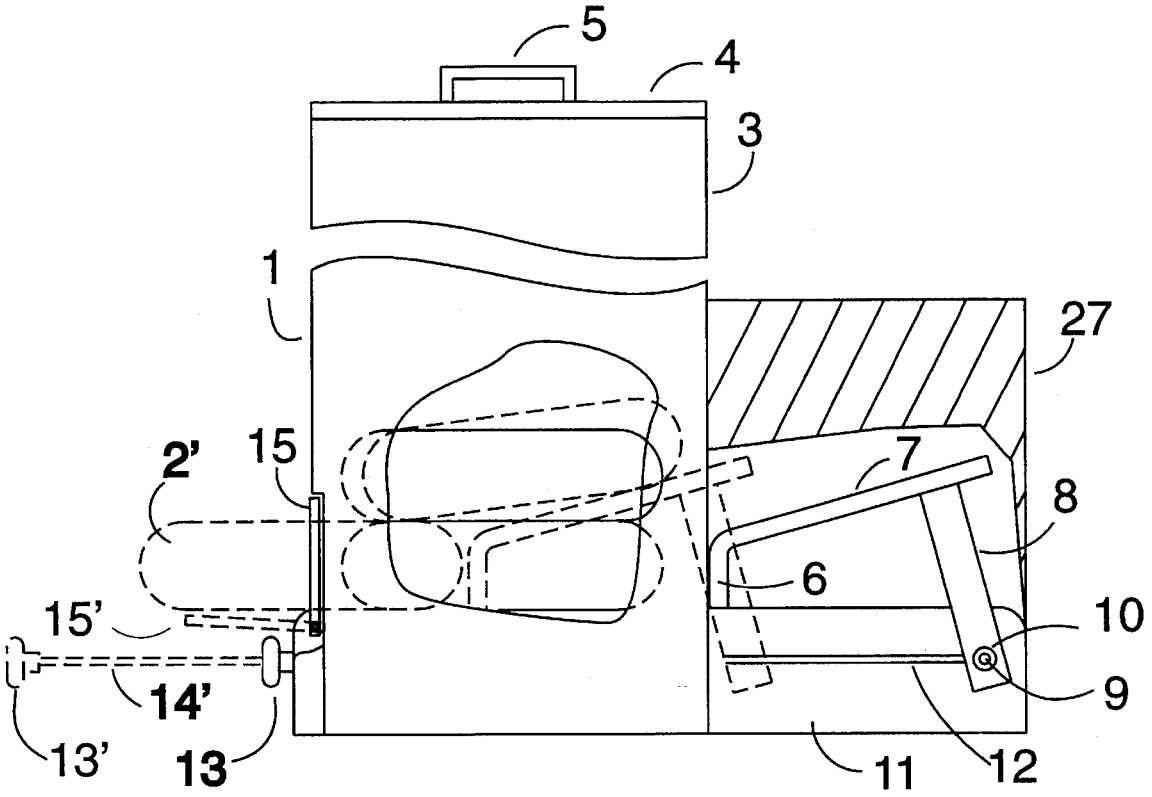
FIG. 1 is a partial cut-away view of the inventive dispenser.
Figure 2:
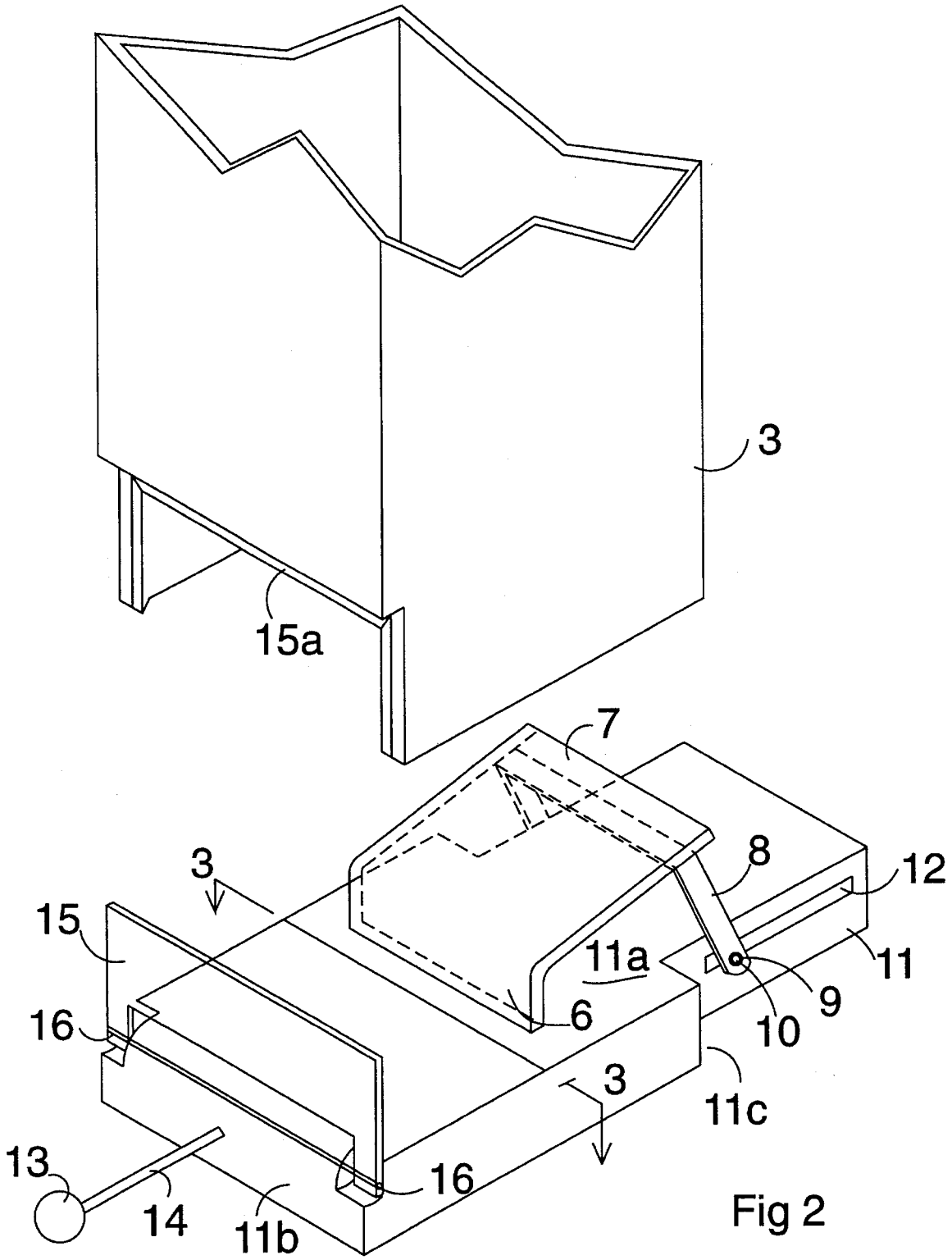
FIG. 2 is a partial exploded view of various components of the inventive dispenser.

FIG. 1 is a partial cut-away view of the dispenser of the present invention. FIG. 2 is a partially exploded view of the dispenser. The dispenser will be described with reference to FIG. 1 and FIG. 2. In FIG. 1, the dispenser is generally represented at 1. The bagels, 2, are stacked in a single column inside a storage column, 3. At the top of the storage column, 3, is a removable cover, 4, which preferable comprises a hand grip, 5. Behind the storage column, 3, is a push assembly comprising a contact face, 6, which contacts and expels the bagel, 2. Attached to the upper extent of the contact face, 6, is an inclined plate, 7, connected to a support member, 8. The support member, 8, comprises a hole, 9, for receiving a finger, 10. The push assembly, and storage column are slidably attached to a base, 11 such that the push assembly slides into the rear entrance slot of the storage column shown below. The base, 11, is substantially rectangular and preferably enclosed. The base is preferably rectangular with the exception of a rearward offset, 11*c*, to accommodate the support member, 8, and fingers, 10. The base comprises a top surface, 11*a*, which is preferably flat and free of protrusions and depressions. A flat top surface is preferred since this would decrease the likelihood of crumbs accumulating in or around the depressions or protrusions. Furthermore, the contact face, 6, slides along the top surface and the action of the contact face tends to push any crumbs, seeds, or the like towards the front of the dispenser which tends to act as an automatic purge. The base comprises a pair of parallel slots, 12, on either side of the base wherein the fingers, 10, transit in concert with the movement of a handle, 13. The handle, 13, is connected to the finger, 10, by a rod, 14, which protrudes through the front of the base, 11*b*. In FIG. 1 the rest position of the various components are shown in the solid lines and the dashed lines represent the position of the various components after the handle has been pulled to activate the dispenser.

To dispense an item the handle, 13, is pulled away from the front of the base to the approximate position indicated by the dashed lines. The handle, 13, withdraws the rod, 14, from the base thereby urging the fingers, 10, to move in concert towards the front of the base, 11. The contact face, 6, of the push assembly urges the bagel into contact with the door, 15, causing the door to rotate on an axle, 16, thereby exposing the bagel to be grasped. As the handle is released the various components return to the rest position as indicated by the solid lines in FIG. 1. A second bagel drops to fill the void left by the dispensed bagel. The operation is then repeated to dispense as many bagels as appropriate. A cover, 27, removably attached to the rear of the base conceals the pusher mechanism and protects the parts from hand contact and insects. An optional, but preferred, seal, 15*a*, insures a tight seal between the door, 15, and storage column, 3.

The push assembly comprises a contact face which pushes the bagel. The contact face preferably forms an angle with the top surface of the base of 80°–100°. More preferably, the contact face forms an angle of 89°–91° with the top surface of the base. The push assembly also comprises an inclined plate which supports the bagels stacked in the storage column. The inclined plate is designed to insure that the bagels in the storage column remain out of the path of the contact face as the bottom-most bagel is dispensed. The upper bagels are lifted slightly by the inclined plate which decreases the pressure on the bottom-most bagel thereby decreasing the force required to slide the bagel along the top surface of the base. It would be apparent that the height of the contact face, as measured from the top surface of the base to the upper extent, is chosen such that there is sufficient surface area to push the bagel without damage yet not so large as to push more than one bagel. Through diligent analysis of the invention, as used specifically with bagels, the preferred height of the contact face is no less than about 0.75 inches and no more than about 2 inches. More preferably the preferred height of the contact face is no less than about 1.0 inch and no more than about 1.5 inches. The angle between the inclined plate and the contact face is preferably at least about 90° and no more than about 130°. More preferably the angle between the inclined plate and the contact face is preferably at least 105° and no more than 130°. At angles lower than about 105° the bagels stacked in the storage column are not sufficiently lifted and the bottom most bagel has difficulty sliding. At angles above about 130° the angle is to steep and the bagels are pushed towards the front wall of the storage column with sufficient force to potentially cause damage. More preferably the angle between the inclined plate and the contact face is at least about 107° and no more than about 115°. An angle of approximately 110° has been found to be most suitable. For use with bagels the width of the contact face and the inclined plate are preferably the same. The width of the contact face is preferably no less than about 3.5 inches and no more than about 5 inches. Below a contact face width of about 3.5 inches the surface area pushing on the bagel is small enough to make indentations in the bagel which is undesirable. A contact face width larger than about 5 inches requires the storage column to be large enough that the bagels can move around laterally and in some cases a bagel may become lodged sideways between a lower bagel and the wall of the storage column. Preferably the width of the contact face is about 4.0 inches to about 4.5 inches.

Figure 3:
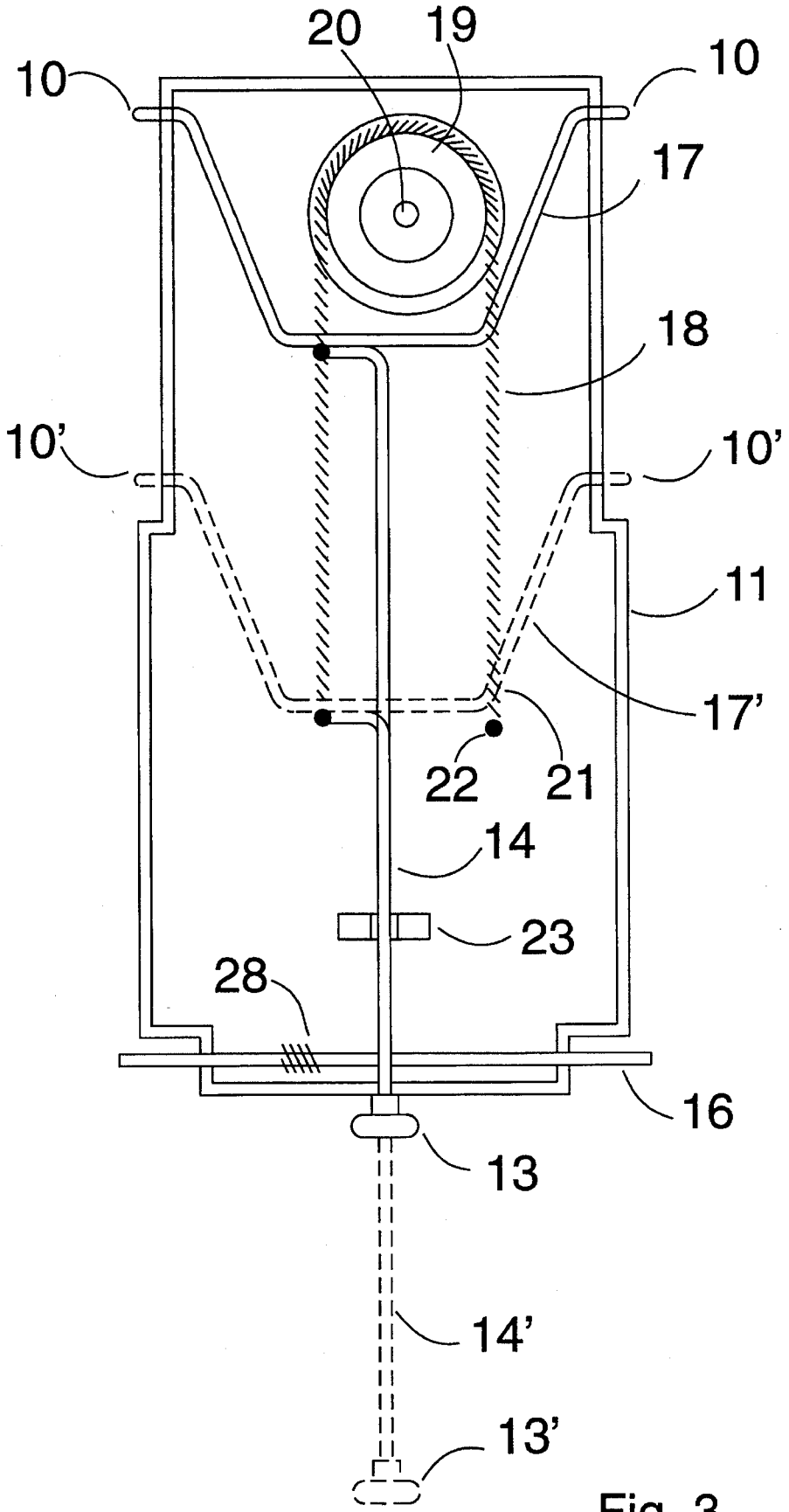
FIG. 3 is a cross-sectional view along line 3—3 of FIG. 2 showing the working mechanism and return mechanism of the inventive dispenser.

FIG. 3 is a sectional view the interior of the inventive bagel dispenser taken along line 3—3 of FIG. 2. In FIG. 3 the fingers, 10, base, 11, handle, 13, and rod, 14, are identical to the similarly labeled elements of FIGS. 1 and 2. The solid lines indicate the rest position of the various components and the dashed lines indicate the position of the various components when the handle is pulled to dispense a bagel. The fingers, 10, are integral to a connector, 17, which is generally "U" shaped. The approximate center of the connector, 17, is attached to the rod, 14. It would be apparent that withdrawing the rod, 14, from the base, 11, would persuade the connector, 17, and fingers, 10, to move towards the front of the base. Opposite the attachment point of the rod, 14, a return line, 18, is attached to the connector, 17. The return line, 18, rotationally engages with a pulley, 19, rotatably mounted on an axle, 20. The return line, 18, connects with one end of a spring, 21. The other end of the spring, 21, attaches to a pin, 22. Alternatively, the return line, 18, and spring, 21, could be a single piece or taken together to represent a single spring or similar item. When the handle is pulled the rod is withdrawn which simultaneously urges the connector and associated parts toward the front of the base. The movement of the connector places a tension on the spring. When the handle is released the spring relaxes which returns the connector, rod, and handle to the rest position. The pulley is preferred and specifically chosen to insure that a long return mechanism can be used. A straight spring attached to the connector and a pin at the rear of the base is contemplated but the spring would be stretched so far as to increase the force required to activate the pusher assembly and the increased tension in the spring causes the pusher assembly to return to the rest position violently. The pulley allows for a long spring and a gentle return to the rest position which is preferred. It would be apparent from FIGS. 1 and 2 that the push assembly moves in concert with the connector since the push assembly is attached at the fingers which are integral to the connector. An optional, but preferred guide block, 23, supports the rod, 14, and facilitates smooth operation. A coil spring. 28, is attached to the axle, 16, to insure that the door is preferably covering the front exit slot when in the rest position.

Figure 4:
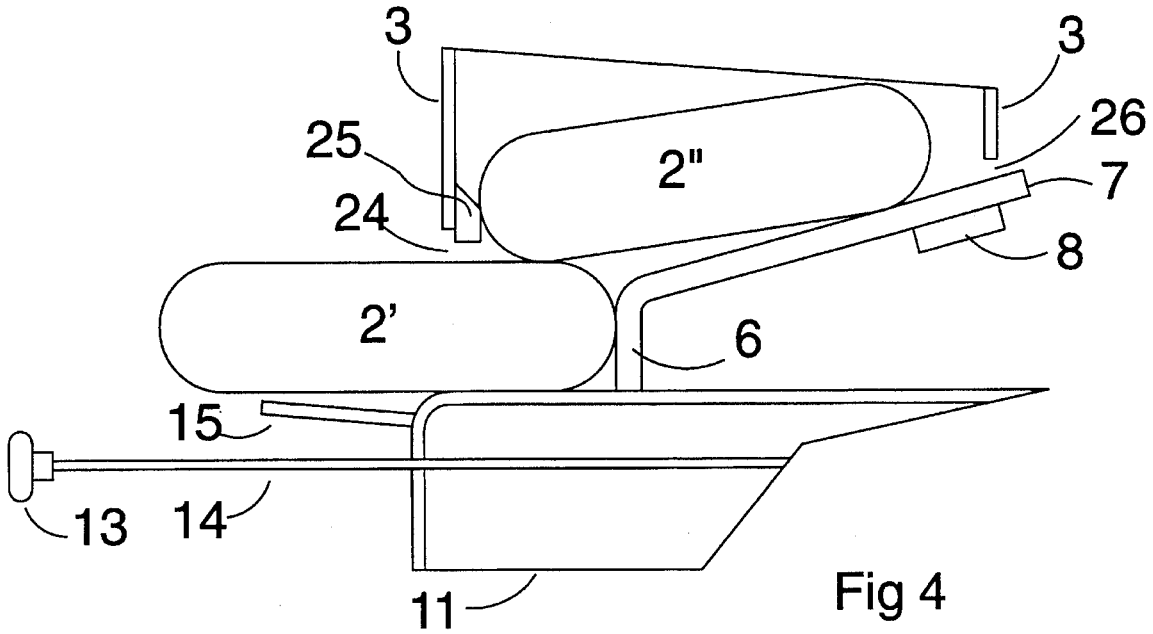
FIG. 4 is a partial cross-sectional view of a portion of FIG. 1.

FIG. 4 is a partial view taken in the center of the inventive dispenser along line 4—4 of FIG. 1. In FIG. 4 the bottom-most bagel, 2', is being dispensed while a second bagel, 2" is cued in the storage column, 3. The contact face, 6, pushes the bottom-most bagel partially out of the exit slot, 24. A beveled chuck, 25, is attached to the front interior wall of the storage column, 3. The chuck, 25, is beveled upward towards the wall of the storage column to assist in lifting the second bagel, 2", off of the bottom-most bagel, 2'. A rear entrance slot, 26, in the storage column, 3, allows the pusher assembly to transit into and out of the storage column.

The pusher assembly transits along the top of the base as detailed herein. The distance traveled by the pusher assembly, as measured from the rest position of the contact face, to the position of the contact face with the rod fully extended is preferably sufficient to insure that the bagel is partially exposed.

The material of construction of the various components is not limiting. Preferably, the materials are chosen to insure adequate strength. The storage column is preferably translucent on at least the front. Preferably, the majority of the storage column is translucent to allow a maximum amount of light into the column and therefore maximum visual appeal. The base is preferably opaque to obscure the view of the working parts. Plastics are preferred since they are more easily molded or formed into the requisite components.

The method of construction is not limiting. The various components can be manufactured by virtually any method known in the art including, vacuum form, die cast and the like.

It is also contemplated that a multiplicity of dispensers could be installed side by side into a unit. This would provide for a dispenser station which is both functional and aesthetically pleasing in a minimum of space.

It would be apparent from the description herein that the invention may be used to dispense a multitude of items. The specific dimensions are provided herein to provide a skilled artisan with the manner in which the apparatus can be used to dispense bagels. It is the intent that the specific embodiments, including the dimensions, are not intended to limit the scope of the invention in any way.

I claim:

1. A dispenser suitable for dispensing bagels comprising:

a base comprising a top, front and rear;

a storage column attached to said base for stacking a multiplicity of bagels in a single column wherein said storage column comprises a front side a rear side a bottom bagel on said top of said base and a stack of bagels resting on said bottom bagel;

an exit slot in said front side of said storage column;

a push assembly slidably mounted on said base wherein said push assembly comprises;

a contact face comprising an upper extent and having a predetermined height;

an inclined plate attached to the upper extent of said contact face;

a moveable handle connected to said push assembly and extending from said front of said base;

wherein movement of said handle causes said push assembly to move along said top of said base such that said contact face of said push assembly pushes said bottom bagel along said top of said base into said exit slot of said front side of said storage column and said inclined plate lifts said stack of bagels.

2. The dispenser of claim 1 wherein the angle between said inclined plate and said contact face is at least 90° and no more than 130°.

3. The dispenser of claim 2 wherein the angle between said inclined plate and said contact face is at least 107° and no more than 115°.

4. The dispenser of claim 1 wherein the height of said contact face is no less than 0.75 inches and no more than 2 inches.

5. The dispenser of claim 4 wherein the height of said contact face is no less than 1.0 inches and no more than 1.5 inches.

6. The dispenser of claim 1 further comprising a door covering said exit slot.

7. A dispenser for dispensing a bottom item from a vertical stack of items comprising;

a base comprising a top and a bottom;

a pusher assembly slidably attached to said top of said base wherein said pusher assembly comprises a contact face having a predetermined height and comprising an upper extent and a lower extent; and an inclined plate attached to said upper extent of said contact face wherein said inclined plate lifts said stack of items from said bottom item;

a storage column on top of said base wherein said storage column comprises a rear entrance slot and a front exit slot;

a movable handle attached to said pusher assembly such that movement of said handle slides said pusher assembly along said top of said base and into said rear entrance slot of said storage column causing said contact face to slide said bottom item into said front exit slot of said storage column whereby said bottom item maintains contact with said base.

8. The dispenser of claim 7 wherein the angle between said inclined plate and said contact face is at least 90° and no more than 130°.

9. The dispenser of claim 8 wherein the angle between said inclined plate and said contact face is at least 107° and no more than 115°.

10. The dispenser of claim 7 wherein the height of said contact face is no less than 0.75 inches and no more than 2 inches.

11. The dispenser of claim 10 wherein the height of said contact face is no less than 1.0 inches and no more than 1.5 inches.

12. The dispenser of claim 7 further comprising a spring capable of returning said pusher assembly out of said rear entrance slot.

13. The dispenser of claim 7 further comprising a beveled chuck attached to the inside of said storage column.

14. A dispenser comprising:

a base comprising a front, a top, a right side and a left side and a pair of matching parallel slots along each of said right side and said left side;

a pusher assembly on top of said base comprising;

a contact face having a predetermined height;

an inclined plate extending from said contact face at a predetermined angle;

a pair of support members attached to said inclined plate and extending downward wherein each said support member further comprises a hole aligned with one said slot;

a rod, and associated handle, protruding through said front of said base;

a connector attached to said rod comprising;

a pair of fingers wherein each said finger extends through one of said matching parallel slots of said base and into said hole of said support member;

a storage column comprising;

a front exit slot;

a rear entrance slot.

15. The dispenser of claim 14 wherein the angle between said inclined plate and said contact face is at least 90° and no more than 130°.

16. The dispenser of claim 15 wherein the angle between said inclined plate and said contact face is at least 107° and no more than 115°.

17. The dispenser of claim 14 wherein the height of said contact face is no less than 0.75 inches and no more than 2 inches.

18. The dispenser of claim 17 wherein the height of said contact face is no less than 1.0 inches and no more than 1.5 inches.

* * * * *